US012276057B2

(12) United States Patent
Ogawa et al.

(10) Patent No.: US 12,276,057 B2
(45) Date of Patent: Apr. 15, 2025

(54) SEWING MACHINE

(71) Applicant: JUKI CORPORATION, Tokyo (JP)

(72) Inventors: Tatsuya Ogawa, Tokyo (JP); Takahiro Higa, Tokyo (JP); Kuniaki Sato, Tokyo (JP); Hajime Nakayama, Tokyo (JP); Juan Zhang, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 0 days.

(21) Appl. No.: 18/522,174

(22) Filed: Nov. 28, 2023

(65) Prior Publication Data

US 2024/0175183 A1 May 30, 2024

(30) Foreign Application Priority Data

Nov. 29, 2022 (JP) ..... 2022-190098

(51) Int. Cl.

| | |
|---|---|
| ***D05B 47/04*** | (2006.01) |
| ***D05B 1/12*** | (2006.01) |
| ***D05B 27/10*** | (2006.01) |
| ***D05B 57/10*** | (2006.01) |

(52) U.S. Cl.

CPC ..... *D05B 47/04* (2013.01); *D05B 1/12* (2013.01); *D05B 27/10* (2013.01); *D05B 57/10* (2013.01)

(58) Field of Classification Search

CPC . D05B 47/04; D05B 1/08; D05B 1/12; D05B 27/10–16; D05B 29/00; D05B 29/02; D05B 57/10; D05B 69/12

See application file for complete search history.

(56) References Cited

U.S. PATENT DOCUMENTS

| | | | | |
|---|---|---|---|---|
| 2,730,061 A * | 1/1956 | Czajkowski | ..... | D05B 51/00 242/147 R |
| 2,892,427 A * | 6/1959 | Winberg | ..... | D05B 27/10 112/318 |
| 3,800,719 A * | 4/1974 | Rockerath | ..... | D05B 33/00 112/304 |

(Continued)

FOREIGN PATENT DOCUMENTS

| | | | |
|---|---|---|---|
| CN | 1497088 A * | 5/2004 | |
| DE | 1068536 | 11/1959 | |

(Continued)

OTHER PUBLICATIONS

"Search Report of Europe Counterpart Application", issued on Mar. 13, 2024, p. 1-p. 7.

*Primary Examiner* — Ismael Izaguirre
(74) *Attorney, Agent, or Firm* — JCIPRNET

(57) ABSTRACT

A sewing machine includes: a sewing needle, holding an upper thread; an upper thread tension adjustment mechanism, adjusting a tension of the upper thread; a shuttle cooperating with the sewing needle to form a seam; a feed mechanism, in which endless feed belts feeding a sewing object disposed at a sewing position along a first direction are disposed on two sides with respect to the sewing position in a second direction orthogonal to the first direction, and in which a belt drive part independently driving the feed belts on two sides with respect to the sewing position in the second direction is provided; and a control part, controlling the mechanism, so that, from beginning to end of sewing, a tension of the upper thread varies in an amount according to a difference between feed amounts of the feed belts.

6 Claims, 5 Drawing Sheets

(56) References Cited

U.S. PATENT DOCUMENTS 5,249,540 A * 10/1993 Sielemann ..... D05B 27/10
112/260

FOREIGN PATENT DOCUMENTS

| | | | | | |
|---|---|---|---|---|---|
| DE | 102004019001 | | 12/2004 | | |
| JP | 2017221644 | A * | 12/2017 | ..... | D05B 27/00 |
| JP | 2019212194 | | 12/2019 | | |
| JP | 6994144 | | 1/2022 | | |

* cited by examiner

| Difference(mm) | 0 | 1 | 2 | 3 | 4 | 5 | 6 | 7 | 8 | 9 |
|---|---|---|---|---|---|---|---|---|---|---|
| Tension variation amount(%) | 0 | 5 | 10 | 15 | 20 | 25 | 30 | 35 | 40 | 45 |
| Tension at end of sewing(%) Beginning of sewing: longitudinal | 100 | 95 | 90 | 85 | 80 | 75 | 70 | 65 | 60 | 55 |
| Tension at end of sewing(%) Beginning of sewing: lateral | 100 | 105 | 110 | 115 | 120 | 125 | 130 | 135 | 140 | 145 |

FIG. 4

SEWING MACHINE

CROSS-REFERENCE TO RELATED APPLICATION

This application claims the priority benefit of Japan application no. 2022-190098, filed on Nov. 29, 2022. The entirety of the above-mentioned patent application is hereby incorporated by reference herein and made a part of this specification.

BACKGROUND

Technical Field

The disclosure relates to a sewing machine.

Description of Related Art

In the technical field related to sewing machines, a sewing machine referred to as the so-called lock-stitch sewing machine, as disclosed in Patent Document 1, is known.

[Patent Document 1] Japanese Laid-open No. 2019-212194

In the sewing machine, by making the feed amounts of the sewing object at two sides of the sewing position immediately below the sewing needle different, a curved seam can be formed in the sewing object. In the sewing object, there is a tendency to stretch more easily in the lateral direction or a bias direction inclined with respect to the longitudinal direction than the longitudinal direction as the winding direction. At the time of forming a curved seam in the sewing object, if a seam is formed in the lateral direction or the bias direction while matching the tension of the upper thread with sewing in the longitudinal direction, the thread becomes tighter, and a sewing defect, such as wrinkled seams or distorted fabrics, may occur in the sewing object.

The disclosure provides a sewing machine able to suppress a sewing defect from occurring at the time of forming a curved seam in the sewing object.

SUMMARY

An aspect of the disclosure provides a sewing machine. The sewing machine includes: a sewing needle, held by a needle bar and holding an upper thread to move reciprocally; an upper thread tension adjustment mechanism, adjusting a tension of the upper thread; a shuttle, holding a bobbin which is accommodated in a bobbin case and in which a lower thread is wound, and cooperating with the sewing needle to form a seam; a feed mechanism, in which endless feed belts feeding a sewing object disposed at a sewing position immediately below the sewing needle from the sewing position along a first direction along a longitudinal direction of the sewing object are disposed on two sides with respect to the sewing position in a second direction orthogonal to the first direction, and in which a belt drive part is provided the belt drive part independently driving the feed belt on a side and the feed belt on an other side with respect to the sewing position in the second direction; and a control part, controlling the upper thread tension adjustment mechanism, so that, from a beginning of sewing of the sewing object to an end of the sewing, a tension of the upper thread varies gradually in a variation amount in accordance with a difference between a feed amount of the feed belt disposed on the side with respect to the sewing position in the second direction and a feed amount of the feed belt disposed on the other side with respect to the sewing position in the second direction.

BRIEF DESCRIPTION OF THE DRAWINGS

FIG. 4 is a diagram illustrating an example of a relationship between the difference between the feed amounts of the feed belts and a tension of an upper thread.

DESCRIPTION OF THE EMBODIMENTS

According to the disclosure, a sewing defect can be suppressed from occurring at the time of forming a curved seam in a sewing object.

Embodiments according to the disclosure will be described below with reference to the drawings. However, the disclosure shall not be limited to the embodiments. In addition, the components in the embodiments described below include those that can be easily replaced by those skilled in the art, or those that are substantially the same.

A sewing machine 1 according to the embodiment is described. In the embodiment, the positional relationship of each component is described based on a local coordinate system defined in the sewing machine 1. The local coordinate system is defined by an XYZ orthogonal coordinate system. A direction parallel to X-axis in a predetermined plane is defined as the X-axis direction (second direction). A direction parallel to Y-axis within a predetermined plane perpendicular to X-axis is defined as the Y-axis direction (first direction). A direction parallel to Z-axis perpendicular to the predetermined planes is defined as the Z-axis direction. A direction of rotation about X-axis is defined as the θX direction.

Figure 1:
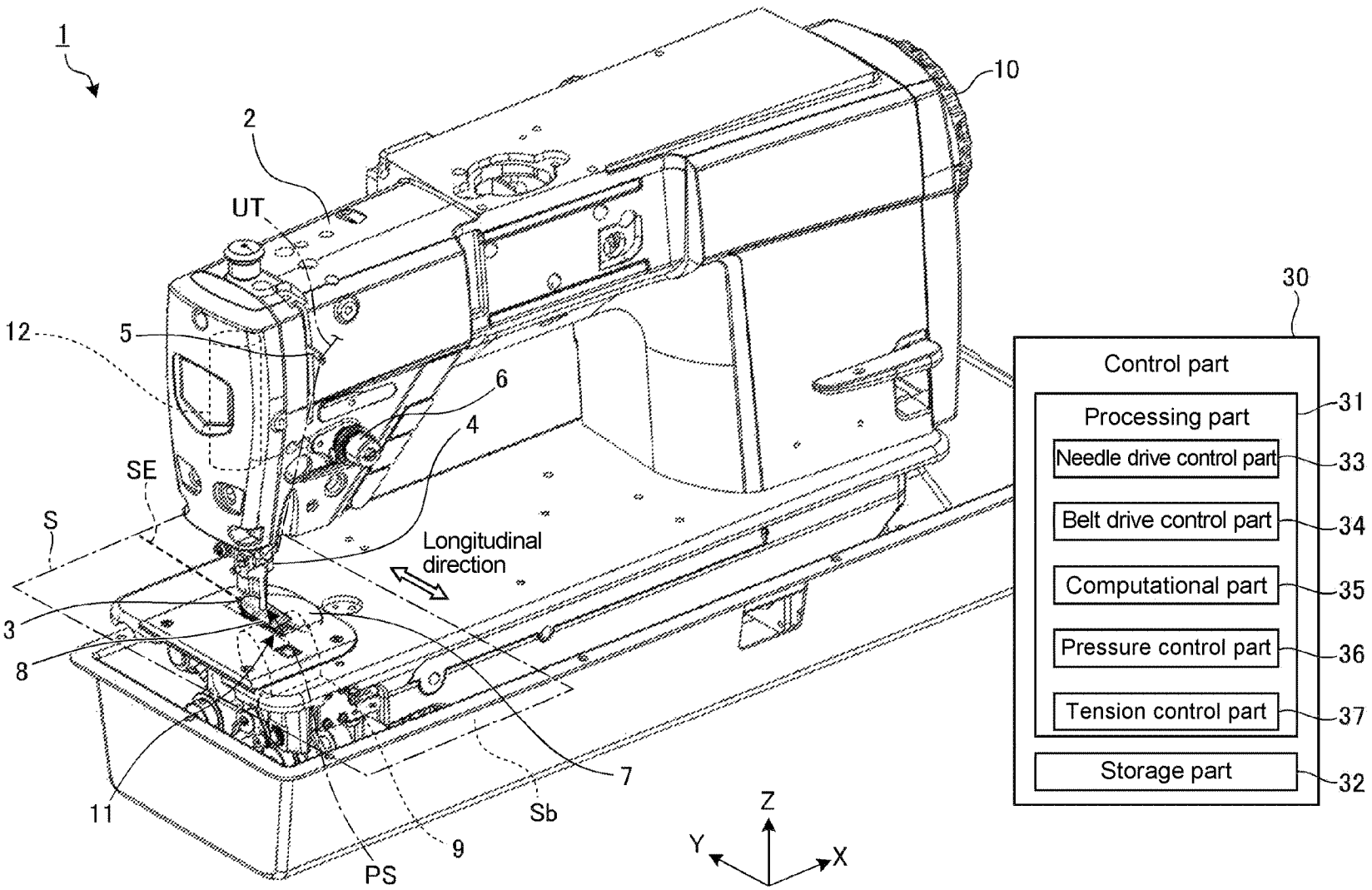
FIG. 1 is a schematic perspective view illustrating a sewing machine according to an embodiment.

FIG. 1 is a schematic perspective view illustrating the sewing machine 1 according to an embodiment. As shown in FIG. 1, the sewing machine 1 includes a sewing machine head 2, a needle bar 4, a take-up 5, a thread tensioner 6, a needle plate 7, a pressing member 8, a shuttle 9, a motor 10, a feed mechanism 11, and a control part 30.

The needle bar 4 holds a sewing needle 3 and moves reciprocally in the Z-axis direction. The needle bar 4 holds the sewing needle 3 so that the sewing needle 3 is parallel to Z-axis. The needle bar 4 is supported by the sewing machine head 2. The needle bar 4 is disposed above the needle plate 7, and is able to face the surface of a sewing object S. An upper thread UT is threaded onto the sewing needle 3. The sewing needle 3 has a thread passing hole through which the upper thread UP passes. The sewing needle 3 holds the upper thread UT by using an inner surface of the thread passing hole. Through the reciprocal movement of the needle bar 4 in the Z-axis direction, the sewing needle 3 reciprocally moves in the Z-axis direction in a state of holding the upper thread UT.

The take-up 5 supplies the upper thread UT to the sewing needle 3. The take-up 5 is supported by the sewing machine head 2. The take-up 5 has a take-up hole through which the upper thread UT passes. The take-up 5 holds the upper thread UT by using an inner surface of the take-up hole. The take-up 5 moves reciprocally in the Z-axis direction in a state of holding the upper thread UT. The take-up 5 is linked with the needle bar 4 to move reciprocally. Through the reciprocal movement in the Z-axis direction, the take-up 5 lets out or pulls up the upper thread 5.

The thread tensioner (upper thread tension adjustment mechanism) 6 applies tension to the upper thread UT. The upper thread UT is supplied to the thread tensioner 6 from a thread supply source. On a passage that the upper thread UT passes through, the take-up 5 is disposed between the sewing needle 3 and the thread tensioner 6. The thread tensioner 6 adjusts the tension of the upper thread UT supplied to the sewing needle 3 via the take-up 5.

The needle plate 7 supports the sewing object S. The sewing needle 3 held by the needle bar 4 and the needle plate 7 are opposite to each other. The needle plate 7 has a needle hole that the sewing needle 3 is able to pass through. The sewing needle 3 that penetrates through the sewing object S supported by the needle plate 7 passes through the needle hole.

The pressing member 8 presses the sewing object S from the above. The pressing member 8 is supported by the sewing machine head 2. The pressing member 8 is disposed above the needle plate 7, and holds the sewing object S with respect to the needle plate 7.

The shuttle 9 holds a bobbin accommodated in a bobbin case. The shuttle 9 is disposed below the needle plate 7. The shuttle 9 rotates in the OX direction. The shuttle 9 is linked with the needle bar 4 to rotate. The shuttle 9 supplies a lower thread LT. The shuttle 9 scoops up the upper thread UT from the sewing needle 3 that penetrates through the sewing object S supported by the needle plate 7 and passes through the needle hole of the needle plate 7.

The motor 10 generates power. The motor 10 has a stator supported by the sewing machine head 2 and a rotor rotatably supported by the stator. Through the rotation of the rotor, the motor 10 generates power. The power generated by the motor 10 is transmitted to the needle rod 4, the take-up 5, and the shuttle 9, respectively, via a power transmission mechanism (not shown). The needle rod 4, the take-up 5, and the shuttle 9 are linked. By transmitting the power generated by the motor 10 to the needle rod 4, the needle rod 4 and the sewing needle 3 held by the needle rod 4 move reciprocally in the Z-axis direction. By transmitting the power generated by the motor 10 to the take-up 5, the take-up 5 is linked with the needle rod 4 to move reciprocally in the Z-axis direction. By transmitting the power generated by the motor 10 to the shuttle 9, the shuttle 9 is linked with the needle rod 4 and the take-up 5 to rotate in the θX direction. The sewing machine 1 sews the sewing object S through the cooperation of the sewing needle 3 held by the needle bar 4 and the shuttle 9.

The feed mechanism 11 delivers the sewing object S from a sewing position PS toward the Y-axis direction. In the embodiment, the feed mechanism 11 is disposed lower than the sewing object S disposed at the sewing position PS. A feed mechanism disposed higher than the sewing object S disposed at the sewing position PS may also be provided separately. The feed mechanism 11 has feed belts 21 and a belt drive part 22.

Figure 2:
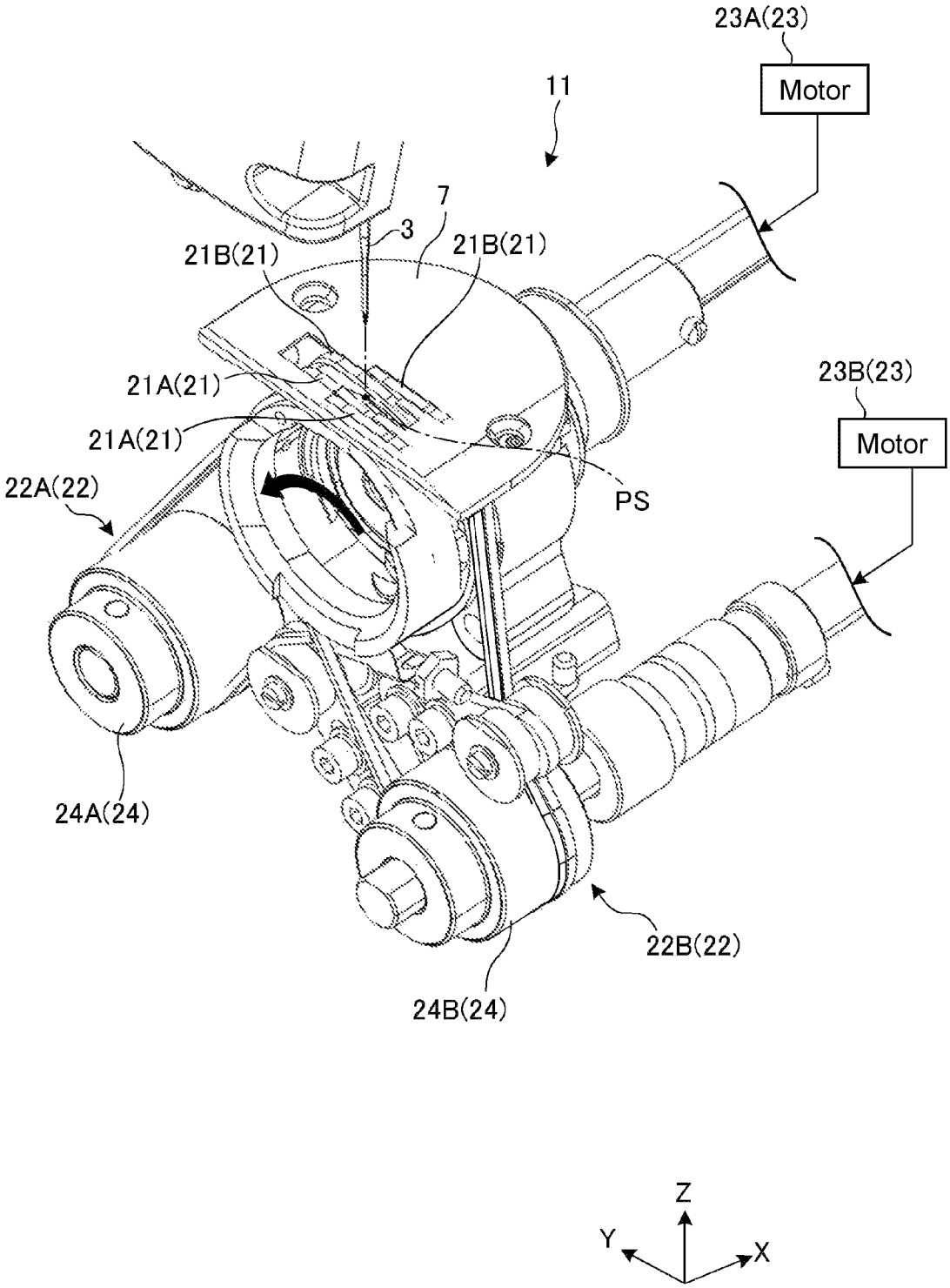
FIG. 2 is a view illustrating an example of a feeding mechanism.

FIG. 2 is a view illustrating an example of the feeding mechanism 11. As shown in FIG. 2, the feed belts 21 contact a back surface Sb of the sewing object S. The feed belt 21 is in a ring shape (endless). The feed belts 21 are disposed on two sides in the X-axis direction with respect to the sewing position PS. On each of the two sides in the X-axis direction with respect to the sewing position PS, two feed belts 21 are disposed. That is, a total of four feed belts 21 are disposed. In the following, the two feed belts 21 disposed on a side (−X side) in the X-axis direction with respect to the sewing position PS are represented as feed belts 21A, and the two feed belts 21 disposed on the other side (+X side) in the X-axis direction with respect to the sewing position PS are represented as feed belts 21B.

The belt drive part 22 independently drives the feed belts 21A on the −X side with respect to the sewing position and the feed belts 21B on the +X side with respect to the sewing position PS. The belt driving part 22 has a drive system 22A that drives the feed belts 21A on the +X side of the sewing position PS and a drive system 22B that drives the feed belts 21B on the +X side of the sewing position PS. The drive system 22A has a motor 23A and a sprocket 24A. The drive system 22B has a motor 23B and a sprocket 24B.

When the motors 23A, 23B operate, the belts 21A supported by a pulley 234 and the belts 21B supported by the sprocket 24B rotate in the Y-axis direction. Through the rotation of the belts 21A, 21B, the sewing object S is delivered in the Y-axis direction. The longitudinal direction of the sewing object S is arranged along the Y-axis direction, which is a delivery direction. The longitudinal direction is the length direction of the roll-like sewing object S. The width direction of the roll-like sewing object S is the lateral direction.

The control part 30 collectively controls the operation of the sewing machine 1. The control part 30 has a processing part 31 and a storage part 32. The processing part 31 performs various information processing. The processing part 31 includes a processor, such as a central processing unit (CPU), and a memory, such as a read only memory (ROM), a random access memory (RAM).

The processing part 31 has a needle drive control part 33, a belt drive control part 34, a computational part 35, and a tension control part 37.

The needle drive control part 33 controls the movement of the sewing needle 3 in the Z-axis direction by controlling the rotation of the motor 10.

The belt drive control part 34 controls the feed amounts of the feed belts 21A, 21B by controlling the rotation of the motors 23A, 23B of the belt drive part 22. In the case where the feed amount of the feed belt 21A and the feed amount of the feed belt 21B are the same, a seam SE formed in the sewing object S is linear. In the case where the feed amount of the feed belt 21A is greater than the feed amount of the feed belt 21B, the seam SE formed in the sewing object S is curved toward the +X side. In the case where the feed amount of the feed belt 21B is greater than the feed amount of the feed belt 21A, the seam SE formed in the sewing object S is curved toward the −X side. The greater the difference between the feed amounts of the feed belts 21A, 21B, the greater the curvature of the seam SE.

The computational part 35 performs various computations. The computational part 35, for example, computes the difference between the feed amount of the feed belt 21A and the feed amount of the feed belt 21B.

The tension control part 37 controls the thread tensioner 6, so that, from the beginning of the sewing of the sewing object S until the end of the sewing, the tension of the upper thread UT gradually changes in a variation amount in accordance with the magnitude of the difference between the feed amount of the feed belt 21A and the feed amount of the feed belt 21B. In such case, the tension control part 37 adjusts the thread tensioner 6, so that the greater the difference between the feed amounts of the feed belts 21A and 21B, the greater the variation amount of the tension of the upper thread UT. In addition, in the case where the sewing of the sewing object S begins from the longitudinal direction, the tension control part 37 adjusts the thread tensioner 6, so that the tension of the upper thread UT gradually decreases until the end of the sewing. In addition, in the case where the sewing of the sewing object S begins from the lateral direction, the tension control part 37 adjusts the thread tensioner 6, so that the tension of the upper thread UT gradually increases until the end of the sewing.

The storage part 32 stores information such as various programs, data. The storage part 32 includes a storage such as a hard disk drive (HDD), a solid state drive (SDD).

With the processor reading various programs and expanding the programs in the memory in the processing part 31, information processing corresponding to the functions of the respective parts is executed in the control part 30. Examples of the various programs may include programs stored in the storage part 32, programs recorded in an external recording medium, etc. The control part 30 serves as an information processing device (computer) executing various information processing. An information processing device other than the control part 13 may execute the various programs, or the control unit 30 and other information processing devices other than the control unit 30 may cooperate to execute the various programs.

In the following, the operation of the sewing machine 1 with such configuration is described. An operator places the sewing object S at the sewing position PS, so that the longitudinal direction is along the Y-axis direction, and the sewing object S is arranged to be pressed by the pressing member 8. In such state, when the operator performs an operation to begin sewing, the needle drive control part 33 of the control part 30 controls the rotation of the motor 10 so that the sewing needle 3 reciprocally moves in the Z-axis direction. In addition, the belt drive control part 34 controls the feed amounts of the feed belts 21A, 21B by controlling the rotation of the motors 23A, 23B of the belt drive part 22.

In the case of forming a linear seam with respect to the sewing object S, the belt drive control part 34 exerts control so that the feed amount of the feed belt 21A and the feed amount of the feed belt 21B are the same. Also, in the case of forming a scam SE curved toward the +X side with respect to the sewing object S, the belt drive control part 34 exerts control so that the feed amount of the feed belt 21A is greater than the feed amount of the feed belt 21B. Also, in the case of forming a seam SE curved toward the −X side with respect to the sewing object S, the belt drive control part 34 exerts control so that the feed amount of the feed belt 21B is greater than the feed amount of the feed belt 21A.

Figure 3:
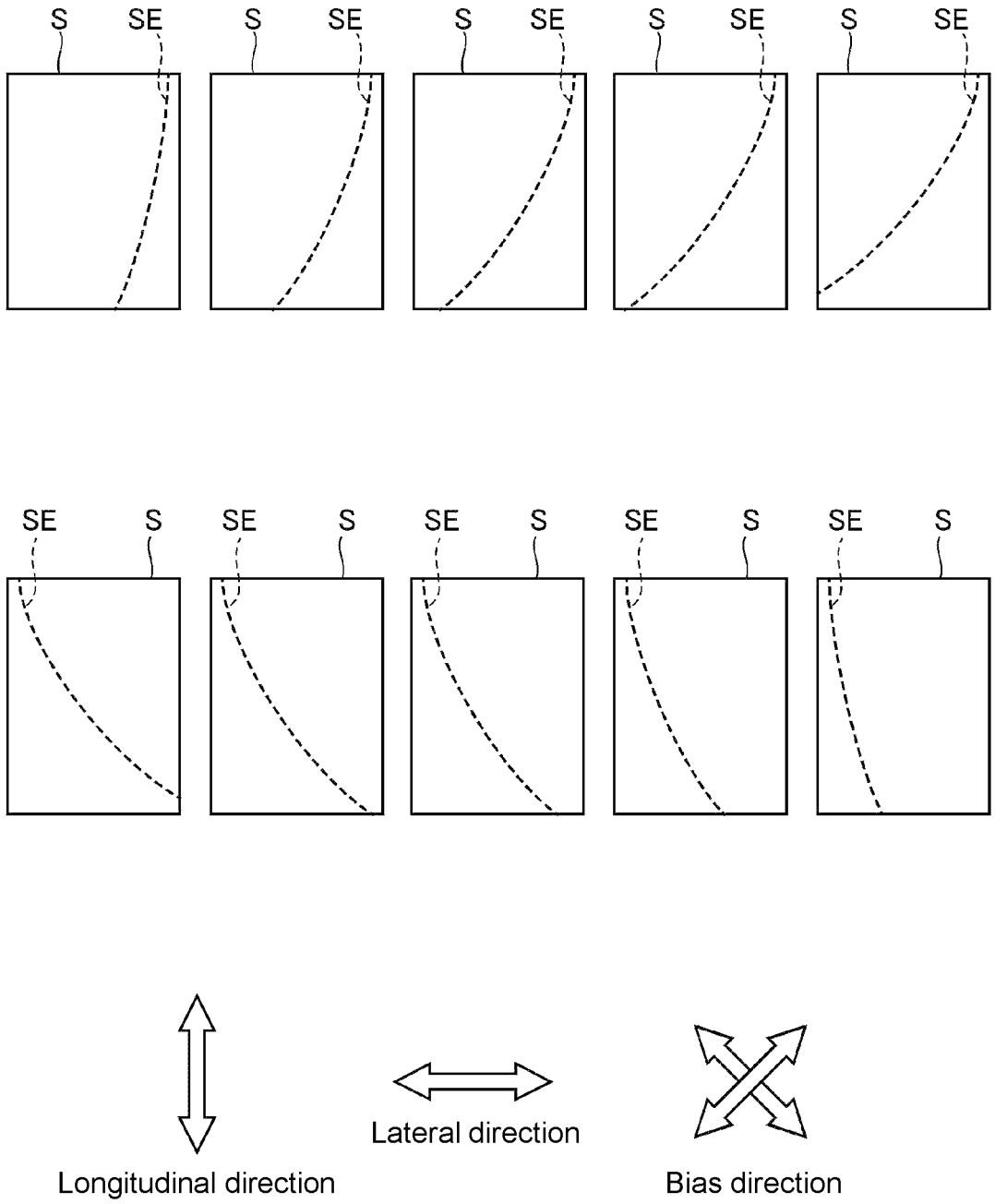
FIG. 3 is a diagram illustrating an example of a relationship between a difference between feed amounts of feed belts and a curvature of a seam formed in a sewing object.

FIG. 3 is a diagram illustrating an example of a relationship between the difference between the feed amounts of the feed belts 21 and the curvature of the seam SE formed in the sewing object S. In the upper part of FIG. 3, examples in the case where the feed amount of the feed belt 21A is constant (e.g., the feed amount per unit time is 1 mm), and the feed amount of the feed belt 21B is increased from the left side of the figure toward the right side are shown. Also, in the lower part of FIG. 3, examples in the case where the feed amount of the feed belt 21B is constant (e.g., the feed amount per unit time is 1 mm), and the feed amount of the feed belt 21A is increased from the right side of the figure toward the left side are shown. As shown in FIG. 3, the greater the difference between the feed amounts of the feed belts 21A, 21B, the greater the curvature of the seam SE.

In the sewing object S, there is a tendency to stretch more easily in the lateral direction or the bias direction inclined with respect to the longitudinal direction than the longitudinal direction that is the winding direction. At the time of forming the seam SE that is curved in the sewing object S, if the seam is formed in the lateral direction or the bias direction while matching the tension of the upper thread UT with sewing in the longitudinal direction, the thread becomes tighter, and a sewing defect, such as wrinkled seams or distorted fabrics, may occur in the sewing object S. Therefore, in the embodiment, at the time of forming the curved seam SE with respect to the sewing object S, control is exerted so that the tension of the upper thread UT is not excessively strong.

Specifically, in the case where the feed amount of the feed belt 21A and the feed amount of the feed belt 21B are different, the computational part 35 calculates the difference between the feed amount of the feed belt 21A and the feed amount of the feed belt 21B.

The tension control part 37 controls the thread tensioner 6 to change in the variation amount in accordance with the magnitude of the difference between the feed amount of the feed belt 21A and the feed amount of the feed belt 21B from the beginning of the sewing of the sewing object S until the end of the sewing. Firstly, the tension control part 37 calculates the variation amount of the tension of the upper thread UT from the beginning of the sewing of the sewing object S until the end of the sewing.

FIG. 4 is a diagram illustrating an example of a relationship between the difference between the feed amounts of the feed belts and the tension of the upper thread. In FIG. 4, regarding the variation amount of the tension of the upper thread UT, the proportion (%) using, as reference, the tension at the beginning of the sewing is shown. As shown in FIG. 4, in the case where the difference between the feed amounts of the feed belts 21 is 0 (mm), the variation amount of the tension of the upper thread UT is 0(%). In this case, the tension control part 37 exerts control so that the tension of the upper thread UT is constant from the beginning of the sewing of the sewing object S until the end of the sewing.

In the example shown in FIG. 4, it is set that as the difference between the feed amounts of the feed belts 21 increases by 1 mm, the variation amount of the tension of the upper thread UT increases by 5(%). For example, in the case where the difference between the feed amounts of the feed belts 21 is 1 (mm), the variation amount of the tension of the upper thread UT is 5(%). In such case, the tension control part 37 controls the thread tensioner 6, so that, from the beginning of the sewing of the sewing object S until the end of the sewing, the tension of the upper thread UT is gradually changed, and the variation amount of the tension at the end of the sewing is 5% with respect to the tension at the beginning of the sewing. It is noted that the relationship between the increased amount of the difference between the feed amounts of the feed belts 21 and the variation amount of the tension of the upper thread UT is not limited to the example shown in FIG. 4.

Figure 5A:
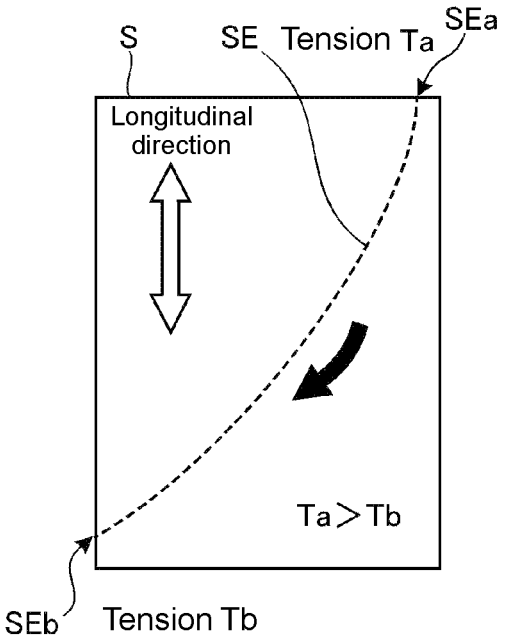
FIGS. 5A and 5B are schematic diagrams illustrating an example of a relationship between a sewing beginning direction of the sewing object and a variation of the tension of the upper thread.
Figure 5B:
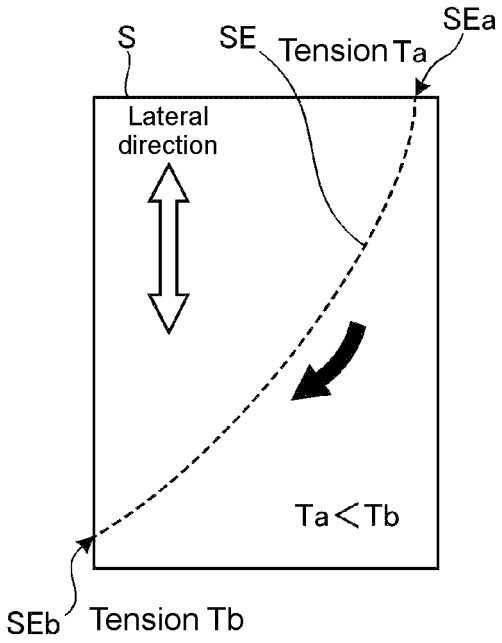

FIGS. 5A and 5B are schematic diagrams illustrating an example of a relationship between a sewing beginning direction of the sewing object S and the variation of the tension of the upper thread UT. As shown on FIG. 5A, in the case where the sewing of the sewing object S begins from the longitudinal direction, the tension control part 37 controls the thread tensioner 6, so that the tension of the upper thread UT gradually decreases from the beginning of the sewing of the sewing object S until the end of the sewing. That is, the tension control part 37 gradually varies the tension of the upper thread UT from a sewing beginning SEa until a sewing end SEb, so that a tension Tb at the end of the sewing is smaller than a tension Ta at the beginning of the sewing of the sewing object S.

For example, considering also the example shown in FIG. 4, in the case where the difference between the feed amounts of the feed belts 21 is 1 mm, and the sewing of the sewing object S begins in the longitudinal direction, the tension control part 37 controls the thread tensioner 6, so that the tension of the upper thread UT gradually decreases from the beginning of the sewing of the sewing object S until the end of the sewing, and the decrease amount of the tension is 5%. That is, the tension control part 37 gradually decreases the tension of the upper thread UT, so that, when the tension of the upper thread UT at the beginning of the sewing is 100 (g), the tension of the upper thread UT at the end of the sewing is 95 (g).

In addition, as shown on FIG. 5B, in the case where the sewing of the sewing object S begins from the lateral direction, the tension control part 37 controls the thread tensioner 6, so that the tension of the upper thread UT gradually increases from the beginning of the sewing of the sewing object S until the end of the sewing. That is, the tension control part 37 gradually varies the tension of the upper thread UT from the sewing beginning SEa until the sewing end SEb, so that the tension Tb at the end of the sewing is greater than the tension Ta at the beginning of the sewing of the sewing object S.

For example, considering also the example shown in FIG. 4, in the case where the difference between the feed amounts of the feed belts 21 is 1 mm, and the sewing of the sewing object S begins in the lateral direction, the tension control part 37 controls the thread tensioner 6, so that the tension of the upper thread UT gradually increases from the beginning of the sewing of the sewing object S until the end of the sewing, and the increase amount of the tension is 5%. That is, the tension control part 37 gradually increases the tension of the upper thread UT, so that, when the tension of the upper thread UT at the beginning of the sewing is 100 (g), the tension of the upper thread UT at the end of the sewing is 105 (g).

For example, by setting in advance the number of stitches or the sewing length for the sewing of the sewing object S, the tension control part 37 can control the thread tensioner 6, so that the tension of the upper thread UT varies in accordance with the number of stitches or the sewing length.

Also, it may also be that the operator sets the variation amount (%) of the tension of the upper thread UT for in the case where the difference between the feed amounts of the feed belts 21 is the maximum (9 mm in the example of FIG. 4), for example. In such case, the tension control part 37 can be set, so that, as the difference between the feed amounts increases from 0 to the maximum, the variation amount of the tension of the upper thread UT gradually increases from 0%.

According to the above, the sewing machine 1 according to the embodiment includes: the sewing needle 3, held by the needle rod 4 and holding the upper thread to move reciprocally; the thread tensioner 6, adjusting the tension of the upper thread; the shuttle 9, holding the bobbin which is accommodated in the bobbin case and in which the lower thread is wound, and cooperating with the sewing needle to form a seam SE; the feed mechanism 11, in which the endless feed belts 21 feeding the sewing object S disposed at the sewing position PS immediately below the sewing needle 3 from the sewing position PS toward the Y-axis direction along the longitudinal direction of the sewing object S are disposed on two sides with respect to the sewing position PS in the X-axis direction orthogonal the Y-axis direction, and in which the belt drive part is provided, the belt drive part independently driving the feed belts 21 on the −X side and the feed belts 21 on the +X side with respect to the sewing position PS in the X-axis direction; the control part 30, controlling the thread tensioner 6, so that, from the beginning of the sewing of the sewing object S to the end of the sewing, the tension of the upper thread varies gradually in the variation amount in accordance with the difference between the feed amount of the feed belt 21 disposed on the −X side with respect to the sewing position PS in the X-axis direction and the feed amount of the feed belt 21 disposed on the +X side with respect to the sewing position PS in the X-axis direction.

According to the configuration, the thread tensioner 6 is controlled so that, from the beginning of the sewing of the sewing object S until the end of the sewing, the tension of the upper thread UT gradually varies in the variation amount in accordance with the difference between the feed amount of the feed belt 21 disposed on the −X side of the sewing position PS and the feed amount of the feed belt 21 disposed on the +X side of the sewing position. Therefore, a sewing defect at the time of forming the seam SE in a direction inclined with respect to the longitudinal direction of the sewing object S can be suppressed.

In the sewing machine 1 according to the embodiment, the control part 30 controls the thread tensioner 6, so that the greater the difference between the feed amounts of the feed belts 21 on the −X side and on the +X side with respect to the sewing position PS in the X-axis direction, the greater the variation amount of the tension of the upper thread UT from the beginning of the sewing until the end of the sewing. According to the configuration, a sewing defect at the time of forming the seam SE in the sewing object S can be reliably suppressed.

In the sewing machine 1 in the embodiment, the control part 30 controls the thread tensioner 6, so that the longitudinal direction is set as the Y-axis direction at the beginning of the sewing of the sewing object S, and in the case where the feed amounts between the feed belt 21 on the −X side and the feed belt 21 on the +X side are different, the tension of the upper thread UT gradually decreases. According to the configuration, a sewing defect at the time of forming the seam SE in the sewing object S can be reliably suppressed.

In the sewing machine 1 in the embodiment, the control part 30 controls the thread tensioner 6, so that the lateral direction is set as the Y-axis direction at the beginning of the sewing of the sewing object S, and in the case where the feed amounts between the feed belt 21 on the −X side and the feed belt 21 on the +X side are different, the tension of the upper thread UT gradually increases. According to the configuration, a sewing defect at the time of forming the seam SE in the sewing object S can be reliably suppressed.

In the sewing machine 1 of the embodiment, the feed mechanism 11 is disposed at least on the lower side with respect to the sewing object S disposed at the sewing position PS. According to the configuration, the sewing object S can be appropriately delivered.

In the sewing machine 1 of the embodiment, the feed mechanism 11 respectively has multiple feed belts 21 on the −X side and on the +X side with respect to the sewing position PS. According to the configuration, the sewing object S can be appropriately delivered.

The technical scope of the disclosure is not limited to the above embodiments, and changes can be made as appropriate without departing from the spirit of the disclosure.

What is claimed is:

1. A sewing machine, comprising:

a sewing needle, held by a needle bar and holding an upper thread to move reciprocally;

an upper thread tension adjustment mechanism, adjusting a tension of the upper thread;

a shuttle, holding a bobbin which is accommodated in a bobbin case and in which a lower thread is wound, and cooperating with the sewing needle to form a seam;

a feed mechanism, in which endless feed belts feeding a sewing object disposed at a sewing position immediately below the sewing needle from the sewing position along a first direction are disposed on two sides with respect to the sewing position in a second direction orthogonal to the first direction, and in which a belt drive part is provided, the belt drive part independently driving the feed belt on a side and the feed belt on an other side with respect to the sewing position in the second direction; and a control part, controlling the upper thread tension adjustment mechanism, so that, from a beginning of sewing of the sewing object to an end of the sewing, a tension of the upper thread varies gradually in a variation amount in accordance with a difference between a feed amount of the feed belt disposed on the side with respect to the sewing position in the second direction and a feed amount of the feed belt disposed on the other side with respect to the sewing position in the second direction.

2. The sewing machine as claimed in claim 1, wherein the control part controls the upper thread tension adjustment mechanism, so that the greater the difference between the feed amounts of the feed belts on the side and on the other side with respect to the sewing position in the second direction, the greater the variation amount of the tension of the upper thread from the beginning of the sewing of the sewing object until the end of the sewing.

3. The sewing machine as claimed in claim 2, wherein the control part controls the upper thread tension adjustment mechanism, so that a longitudinal direction is set as the first direction at the beginning of the sewing of the sewing object, and in a case where the feed amounts between the feed belt on the side and the feed belt on the other side with respect to the sewing position in the second direction are different, the tension of the upper thread gradually decreases.

4. The sewing machine as claimed in claim 2, wherein the control part controls the upper thread tension adjustment mechanism, so that a lateral direction is set as the first direction at the beginning of the sewing of the sewing object, and in a case where the feed amounts between the feed belt on the side and the feed belt on the other side with respect to the sewing position in the second direction are different, the tension of the upper thread gradually increases.

5. The sewing machine as claimed in claim 1, wherein the feed mechanism is disposed at least on a lower side with respect to the sewing object disposed at the sewing position.

6. The sewing machine as claimed in claim 1, wherein the feed mechanism respectively has a plurality of feed belts on the side and on the other side with respect to the sewing position.

* * * * *